US006474004B2

(12) United States Patent
Collavo

(10) Patent No.: US 6,474,004 B2
(45) **Date of Patent: *Nov. 5, 2002**

(54) SKI BOOT

(75) Inventor: Andrea Collavo, Montebelluna (IT)

(73) Assignee: Lange International S.A., Fribourg (CH)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/166,865

(22) Filed: Oct. 6, 1998

(65) Prior Publication Data

US 2002/0062580 A1 May 30, 2002

(30) Foreign Application Priority Data

Nov. 11, 1997 (CH) ..... 2597/97

(51) Int. Cl.[7] ..... A43B 5/04; A43B 5/16
(52) U.S. Cl. ..... 36/119.1; 36/117.1; 36/115
(58) Field of Search ..... 36/119.1, 117.9, 36/117.1, 118.2, 106, 115, 3 R, 3 A, 45, 118.5, 118.3

(56) References Cited

U.S. PATENT DOCUMENTS

| | | | | | |
|---|---|---|---|---|---|
| 3,972,134 | A | * | 8/1976 | Kastinger | 36/118.2 |
| 4,308,674 | A | * | 1/1982 | Tessaro | 36/118.2 |
| D272,484 | S | * | 2/1984 | Sartor | 36/117.1 |
| 5,171,033 | A | * | 12/1992 | Olson et al. | 36/3 R |
| 5,177,884 | A | * | 1/1993 | Rullier | 36/117.1 |
| 5,411,278 | A | * | 5/1995 | Wittmann | 36/115 |
| 5,528,841 | A | * | 6/1996 | Pozzobon | 36/115 |
| 5,570,522 | A | * | 11/1996 | Olson et al. | 36/50.5 |
| 5,588,228 | A | * | 12/1996 | Foscaro et al. | 36/117.3 |
| 5,678,833 | A | * | 10/1997 | Olson et al. | 36/115 |
| 5,718,067 | A | * | 2/1998 | Ostinet et al. | 36/117.1 |
| 5,772,220 | A | * | 6/1998 | Gaster | 36/115 |
| 5,878,513 | A | * | 3/1999 | Annovi et al. | 36/115 |

FOREIGN PATENT DOCUMENTS

| | | | | |
|---|---|---|---|---|
| DE | 4200547 | * | 7/1992 | 36/45 |
| EP | 0252517 | * | 1/1988 | 36/117.9 |
| EP | 0645101 A | | 3/1995 | |
| EP | 0699399 A | | 3/1996 | |
| FR | 2077184 A | | 10/1971 | |
| FR | 2379263 | * | 10/1978 | 36/117.1 |
| FR | 2499834 | * | 8/1982 | 36/117.1 |

OTHER PUBLICATIONS

Copy of International Search Report listing references cited.

* cited by examiner

*Primary Examiner*—Anthony D. Stashick
(74) *Attorney, Agent, or Firm*—Bugnion S.A.; John Moetteli

(57) ABSTRACT

Ski boot whose upper consists of a variable-volume plastic shell (1) provided with at least one tightening device (5, 6). The outer side (A) of the shell has zones (A', A") which are of substantially lower rigidity than the rest of the shell and lie on either side of a stronger band (15) which extends obliquely from the heel to the front end of the shell and bears one of the parts of the tightening device. The effect of said band is to keep the foot bearing against the inner side of the shell, and thus to improve edge setting.

7 Claims, 2 Drawing Sheets

SKI BOOT

FIELD OF THE INVENTION

The present invention relates to a ski boot whose upper consists of a variable-volume plastic shell which is closed over the foot and the instep by two superimposed flaps and is provided with at least one tightening device comprising a part secured to the inner side of the shell, that is to say the side corresponding to the inside of the foot, and a part fixed on the outer side of the shell, the outer side of the shell having zones of substantially lower rigidity than the rest of the shell.

PRIOR ART

Patent FR 2 077 184 proposes the production of ski boots having characteristics as close as possible to a leather boot by using two or more plastics having different mechanical properties. The shell of the boot is formed by successively injecting plastic, with reinforcing elements being introduced at specific points in the injected plastic. The shell obtained is thus a relatively flexible shell provided with reinforcing zones for anchoring the buckles of the boot.

In addition, patent application EP 0 645 101 discloses a ski boot shell having zones of different rigidities and strengths, the strongest and most rigid parts constituting a form of triangular frame whose purpose is to ensure optimum transmission of forces between the leg and the binding.

The object of these designs is to reduce the weight of the boot without weakening the anchoring of the buckles and while ensuring that the boot is still rigid enough to act properly as an interface between the foot and the ski.

The present invention has a different object, namely better support of the foot in the boot and better edge setting.

SUMMARY OF THE INVENTION

To this end, the ski boot according to the invention is one wherein said zones of substantially lower rigidity than the rest of the shell lie on either side of a stronger band which extends obliquely from the heel to the front end of the shell and bears one of the parts of the device for tightening the shell.

Since the shell is made of plastic, greater strength will generally be synonymous with greater rigidity.

When the shell is tightened around the foot, the oblique band which lies on the outer side of the shell will press the foot against the inner face of the inner side of the shell while enclosing it, and will pull the foot rearward and press the heel of the foot against the bottom of the shell, but passing between the malleolar region and the region of the metatarsophalangeal joint, which are sensitive zones. The foot is thus kept bearing against rigid parts of the shell, in particular against the shell wall lying on the inner side of the foot, against which the foot will naturally bear when an edge is being set. Since the foot permanently bears against the inner side of the shell, the edges will be set without play, and therefore immediately and more accurately.

The shell is preferably provided with two fastening devices.

The stronger band preferably extends along a curve approximately in the form of an arc of a circle whose center of curvature lies below the boot, and preferably in front of the boot.

Put another way, the stronger band extends along a diagonal which follows the curvature of the boot.

According to one embodiment, the exterior side of the shell has two zones of lower rigidity, on either side of said stonger band, one facing the region of the metatarsophalangeal joint and one lying between the heel and the malleolar region.

BRIEF DESCRIPTION OF THE DRAWINGS

The appended drawing represents an embodiment of the boot according to the invention by way of example.

DESCRIPTION OF THE PREFERRED EMBODIMENT

Figure 1:
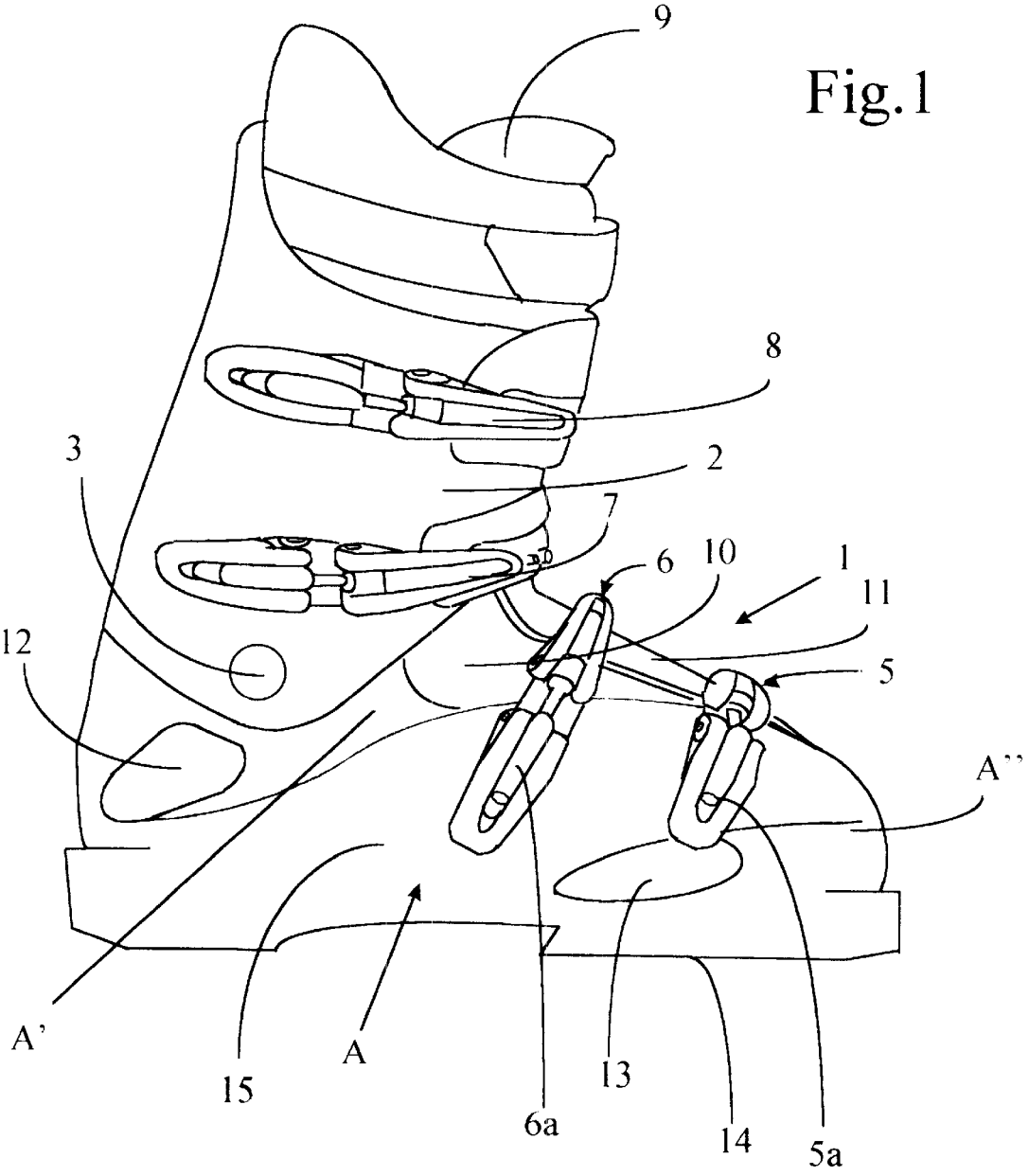
FIG. 1 represents the boot seen from the outer side of the foot.
Figure 2:
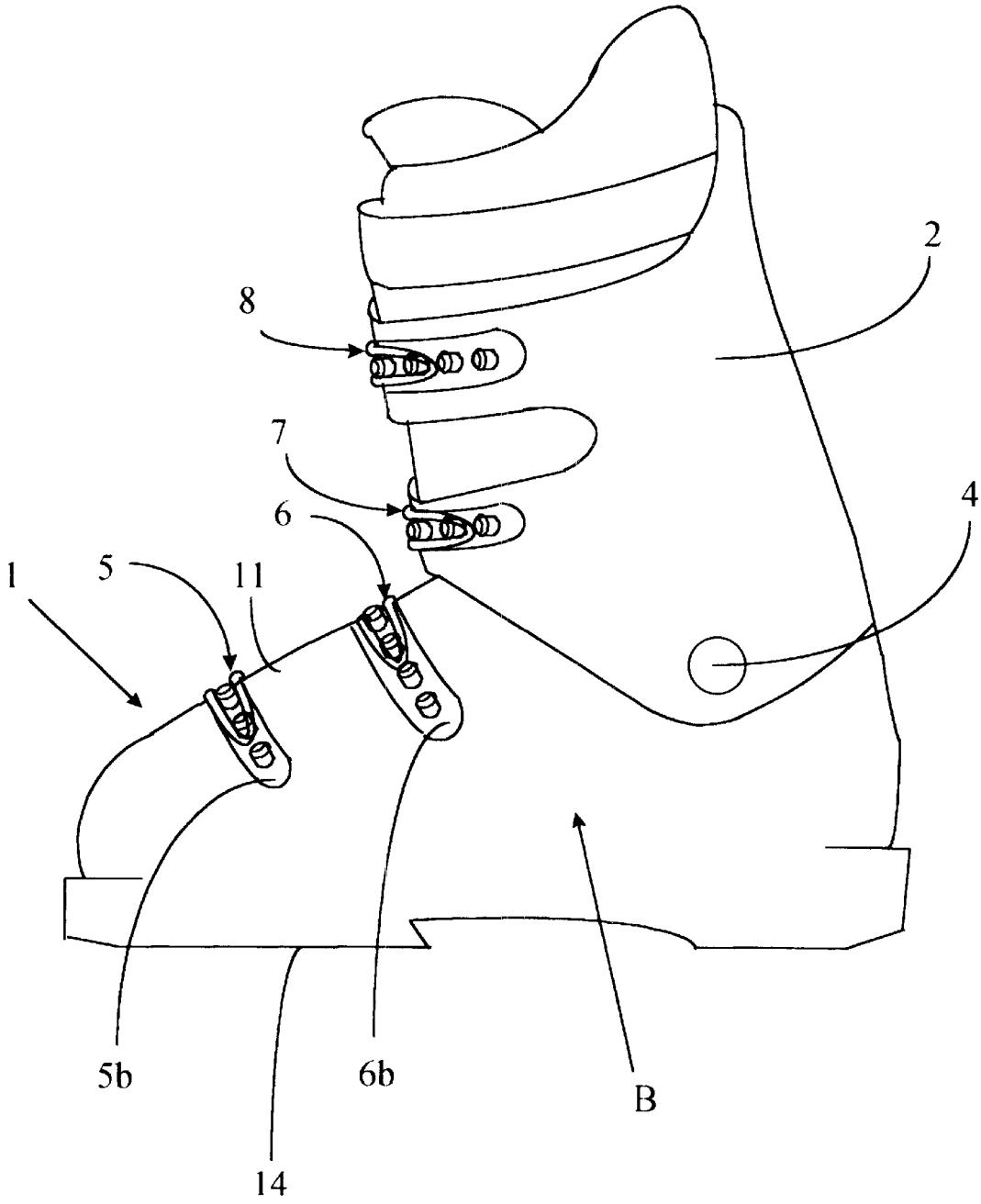
FIG. 2 represents the boot seen from the inner side of the foot.

The boot which is represented is a plastic boot consisting of a shell 1, referred to as a variable-volume shell, intended to enclose the foot and the ankle, and a cuff 2 articulated to the shell 1 at two opposite points 3 and 4 lying in the malleolar region, the cuff 2 being intended to enclose the lower leg. According to a well-known design, this boot is provided with two tightening buckles 5 and 6 for tightening the shell 1, and two buckles 7 and 8 for tightening the cuff 2. A comfort inner boot 9 can also be seen.

In the known way, the variable-volume shell 1 is closed over the foot and over the instep by two flaps 10 and 11, flap 11 extending the inner side B of the shell and being superimposed on the flap 10 secured to the outer side A of the shell.

In the example in question, the shell 1 consists of two layers of plastic, combined by a dual injection or multiple injection process, or alternatively by adhesive bonding or another equivalent process. The plastics which are used are preferably polyurethane. The layer lying toward the inside of the shell consists of a plastic that is substantially more flexible than the outer layer, which includes the sole 14, the inner side B of the shell and the majority of the outer side A. The inner layer is exposed on the outer side A in a first cutout 12 of the outer layer, lying between the heel of the boot and the malleolar region, that is to say the articulation 3, and in a second cutout 13 of the outer layer, located in such a way as to lie facing and around the metatarsophalangeal joint, and it also forms the lower flap 10 in extension of the outer side A of the shell.

On the outer side A of the shell, the outer plastic layer also has a first thinned zone A', between the malleolar region and the instep, and a second thinned zone A", above the metatarsophalangeal region, these thinned zones A', A" presenting, as a thicker region, a band 15 extending obliquely between the cutouts 12 and 13, from the heel of the boot to the front end of the shell, along a curve approximately in the form of an arc of a circle whose center of curvature lies below and toward the front of the boot. At its ends, this band 15 merges, on the outer side, with the lower part of the shell and, on the other side, with the inner side B of the shell, so that there is continuity, in terms of thickness, between the band 15 and the inner side B. The buckles 5 and 6 consist of tensioning levers 5*a* and 6*a* whose bases are fixed in the band 15, these tensioning levers being provided with hooking members which hook into racks 5*b* and 6*b* fixed on the inner side of the shell.

When the buckles 5 and 6 are tightened, tension is exerted on the strong band 15 which, in similar fashion to a strap, pulls the foot laterally and rearward and presses it against the wall of the inner side of the shell and against the rear of the shell. The foot is thus perfectly and permanently held firmly bearing laterally against the rigid inner side of the shell, which ensures immediate and accurate edge setting and accurate guidance of the ski.

The invention is not limited to the embodiment which is represented. In particular, the shell of the boot could consist of a single plastic having zones of different thicknesses, or materials having different mechanical characteristics. What is essential is that, on the outer side of the boot, a band is obtained which is strong enough to support the tightening devices and the tension exerted on them.

What is claimed is:

1. A ski boot for a foot, the ski boot having an interface for a ski binding (20*a*, 20*b*), an inside, a top, an instep, a heel a sole, and an upper consisting of a variable-volume plastic shell (1) which is closed over the top of the foot and the instep by two overlapping flaps (10, 12) provided with at least one tightening device (5, 6) comprising a part secured to an inner side (B) of the shell, that is to say, a side corresponding to the inside of the foot, and a part fixed on an outer side (A) of the shell, the outer side of the shell having zones of substantially lower rigidity than remaining portions of the shell, wherein said zones (12, 13, 14) of substantially lower rigidity than the remaining portions of the shell lie on either side of a stronger, continuous band (15) extending along a curve whose center of curvature is forward of the middle of the sole and below the boot, which progressively rises from the heel to the top of the front end of the shell, adjacent to and above the metatarsophalangeal region and which supports a tightening device (5*a*, 6*a*).

2. The ski boot as claimed in claim 1, wherein the outer side (A) of the shell has two zones (12, 13) of lower rigidity, on either side of said band (15), one facing the region of the metatarsophalangeal joint and one lying between the heel and the malleolar region.

3. The ski boot as claimed in claim 2, wherein the flap (10) secured to the outer side of the shell constitutes a third zone of lower rigidity.

4. The ski boot as claimed in claim 1, whose shell consists of two plastics of different rigidities, wherein said zones of lower rigidity consist solely of the less rigid plastic.

5. The ski boot as claimed in claim 4, wherein, on the outer side of the shell, the more rigid plastic has thinned zones (A', A") in the malleolar region (A') and the metatarsophalangeal region (A").

6. The ski boot as claimed in claim 1, the shell of which consists of a single plastic, wherein said band (15) is a least in part delimited by thinned zones (A', A").

7. The ski boot as claimed in claim 1, the shell of which consists of several plastics, wherein said band (15) is formed from a material of higher intrinsic rigidity.

* * * * *